US005294130A

United States Patent [19]

Woods et al.

[11] Patent Number: 5,294,130

[45] Date of Patent: Mar. 15, 1994

[54] TOMAHAWK BOARD GAME

[76] Inventors: Earnest Way Woods; Annette A. Woods, both of 2410-B Huddersfield Wy., Norcross, Ga. 30071

[21] Appl. No.: 68,001

[22] Filed: May 28, 1993

[51] Int. Cl.[5] ..... A63B 67/00

[52] U.S. Cl. ..... 273/346; 273/428; 273/DIG. 30

[58] Field of Search ..... 273/346, 428, DIG. 30, 273/343, 344, 345, 347

[56] References Cited

U.S. PATENT DOCUMENTS

| | | | |
|---|---|---|---|
| D. 270,654 | 9/1983 | Barrett | D22/117 |
| D. 318,896 | 8/1991 | Crain | D22/117 |
| 2,714,509 | 8/1955 | Ramsey | 273/428 X |
| 3,032,345 | 5/1962 | Lemelson | 273/346 |
| 3,857,566 | 12/1974 | Lemelson et al. | 273/346 |
| 3,997,162 | 12/1976 | Scullin | 273/346 X |
| 4,049,271 | 9/1977 | Fonti | 273/DIG. 30 X |
| 4,054,120 | 10/1977 | Foley | 273/346 X |
| 4,113,251 | 9/1978 | Imes, Jr. | 273/DIG. 30 X |
| 4,166,618 | 9/1979 | Sheem | 273/346 X |

FOREIGN PATENT DOCUMENTS

| | | | |
|---|---|---|---|
| 2086739 | 5/1982 | United Kingdom | 273/346 |
| 2244933 | 12/1991 | United Kingdom | 273/346 |

*Primary Examiner*—William H. Grieb

[57] ABSTRACT

The tomahawk board game includes a tomahawk-shaped projectile (10) and a game board having a target drawn on at least one side (12). The blade edge (4) of the tomahawk-shaped projectile is covered with the loop side of a hook and loop fastening means which will connect and attach to the hook side of the hook and loop fastening means covering the target area of the game board (3). The blade edge of the tomahawk-shaped projectile is angled (11) to avoid bouncing off the game board. After the tomahawk-shaped projectile is propelled into the air towards the target game board, the blade edge also gives the thrower two chances (6,7) to make connection for scoring.

2 Claims, 1 Drawing Sheet

TOMAHAWK BOARD GAME

SUMMARY OF THE INVENTION

The present invention relates to target games, and in particular to a tomahawk board game. This game was designed with fun and safety in mind. The tomahawk is made of either plastic or foam rubber to make it safe but durable for office use as well as home or camp use. This invention employs a hook and loop fastening means to hold the tomahawk on the game board when it makes contact.

Figure 3:
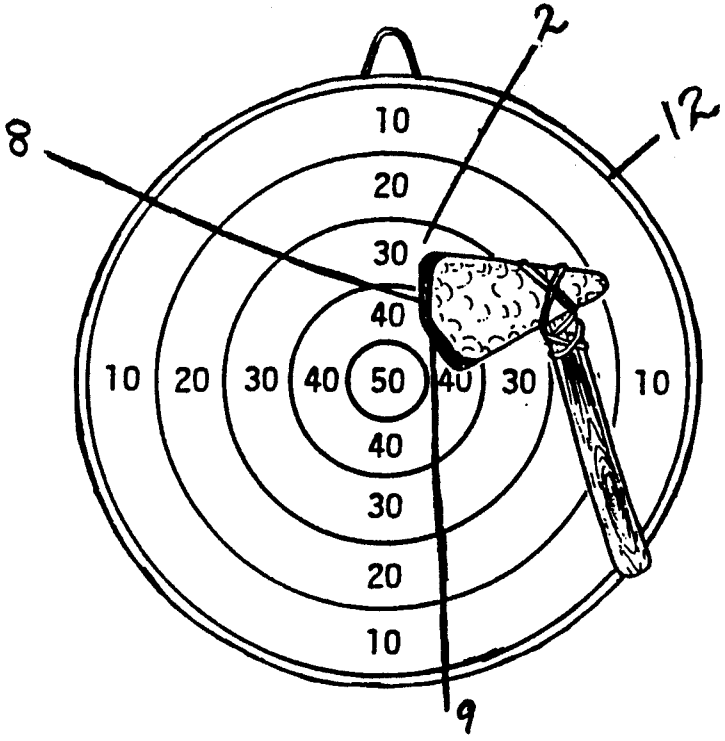

The view in FIG. 3 (2) shows the front of the game board after the tomahawk has made contact.

Figure 1:
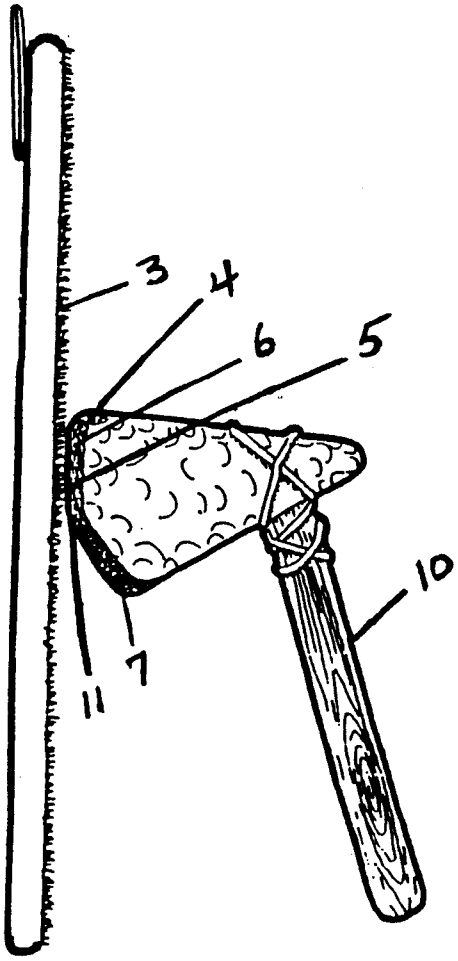
FIG. 1 shows the side view of the tomahawk after it has made contact with the game board.

In FIG. 1, the game board (3) and the tomahawk (4) are shown at a side view to illustrate how they connect (5). The tomahawk's blade edge (4) which is used for scoring has the loop side of the hook and loop fastening means attached to it. The game board (3) is covered with the hook side of the hook and loop fastening means. When the tomahawk blade makes contact with the game board (5), the two sides of the hook and loop fastening means will connect and hold.

Figure 2:
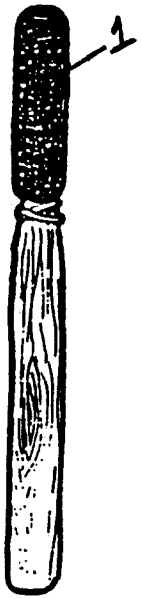
FIG. 2 shows the tomahawk from a frontal angle (1) illustrating the blade that will stick to the target.

The drawing in FIG. 3 also shows the tomahawk on a game board to illustrate how the game looks while being played. Both FIGS. 1 (6,7) and 3 (8,9) illustrate the blade edge of the tomahawk as having two sides rather than one. This is to allow for a better chance of the blade to make contact with the game board. FIG. 2 shows the front view of the tomahawk illustrating the slender design with the blade edge (1) covered with the loop side of the hook and loop fastening means.

We claim:

1. Apparatus for playing a game comprising;

a game board with target areas marked on the surface and a projectile in the shape of a tomahawk which is thrown at the board with the intention of the tomahawk making contact and staying within the target areas, said target surface being covered with one component of hook-and-loop fastening means, and the blade of said tomahawk being covered with the other component of said hook-and-loop fastening means, whereby when the blade and the target surface make contact the two components of the hook-and-loop fastening means will mesh together to hold the projectile to the target surface.

2. Apparatus according to claim 1, wherein the target surface is covered with the hook component, and the blade of the tomahawk is covered with the loop component of the hook-and-loop fastening means, and the blade is angled to provide two surfaces for making contact with the target surface.

* * * * *